US006921879B2

(12) United States Patent
Haluschka et al.

(10) Patent No.: US 6,921,879 B2
(45) Date of Patent: Jul. 26, 2005

(54) SHEATH TYPE GLOW PLUG WITH ION CURRENT SENSOR AND METHOD FOR OPERATION THEREOF

(75) Inventors: Christoph Haluschka, Klingenberg (DE); Juergen Arnold, Benningen (DE); Christoph Kern, Aspach (DE)

(73) Assignee: Robert Bosch GmbH, Stuttgart (DE)

( * ) Notice: Subject to any disclaimer, the term of this patent is extended or adjusted under 35 U.S.C. 154(b) by 61 days.

(21) Appl. No.: 10/070,113

(22) PCT Filed: Apr. 14, 2001

(86) PCT No.: PCT/DE01/01472

§ 371 (c)(1),
(2), (4) Date: Jul. 10, 2002

(87) PCT Pub. No.: WO02/02993

PCT Pub. Date: Jan. 10, 2002

(65) Prior Publication Data

US 2003/0010766 A1 Jan. 16, 2003

(30) Foreign Application Priority Data

Jun. 30, 2000 (DE) ..... 100 31 894

(51) Int. Cl.[7] ..... F23Q 7/22

(52) U.S. Cl. ..... 219/270; 219/544; 123/145 A; 123/145 R; 361/265; 361/266

(58) Field of Search ..... 219/270, 544; 1123/145 A, 145 R; 361/264–266

(56) References Cited

U.S. PATENT DOCUMENTS 5,922,229 A 7/1999 Kurano
6,483,079 B2 * 11/2002 Sato et al. ..... 219/270

FOREIGN PATENT DOCUMENTS

DE 34 28 371 8/1984
EP 0834652 A1 * 10/1997
EP 0 989 368 3/2000

* cited by examiner

*Primary Examiner*—Robin Evans
*Assistant Examiner*—Vinod D. Patel
(74) *Attorney, Agent, or Firm*—Kenyon & Kenyon

(57) ABSTRACT

A sheathed-element glow plug having an ionic-current sensor, as well as a method for operating a sheathed-element glow plug having an ionic-current sensor are described, the sheathed-element glow plug having a housing and a rod-shaped heating element arranged in a concentric bore hole of the housing. The heating element has at least one insulating layer as well as a first lead layer and a second lead layer, the first lead layer and the second lead layer being connected via a bar at the end of the heating element on the combustion chamber side, the first and second lead layers and the bar being made of electroconductive ceramic material, and the insulating layer being made of electrically insulating ceramic material. The heating element has a first electrode for detecting ionic current and a second electrode for detecting ionic current which are embedded in the insulating layer or applied on the insulating layer.

17 Claims, 2 Drawing Sheets

SHEATH TYPE GLOW PLUG WITH ION CURRENT SENSOR AND METHOD FOR OPERATION THEREOF

This application is a 371 of PCT/DE01/01472 filed Apr. 14, 2001.

FIELD OF THE INVENTION

The present invention relates to a ceramic sheathed-element glow plug for a diesel engine having an ionic-current sensor.

BACKGROUND INFORMATION

German Published Patent Application No. 34 28 371 describes a ceramic sheathed-element glow plug that includes a ceramic heating element. The ceramic heating element bears an electrode made of a metallic material which is used to determine the electric conductivity of the ionized gas present in the combustion chamber of the internal combustion engine. In this case, the combustion chamber wall is used as the second electrode.

Furthermore, sheathed-element glow plugs are known which have a housing in which a rod-shaped heating element is disposed in a concentric bore hole. The heating element is made of at least one insulating layer, as well as a first and a second lead layer, the first and the second lead layers connected via a bar at the tip of the heating element on the combustion chamber side. The insulating layer is made of electrically insulating ceramic material, and the first and second lead layers, as well as the bar, are made of electroconductive ceramic material.

SUMMARY OF THE INVENTION

The ceramic sheathed-element glow plug of the present invention with ionic-current sensor has an advantage that the sheathed-element glow plug with ionic-current sensor has a very simple design and is inexpensive to manufacture.

It is possible to achieve a design of a sheathed-element glow plug if the glow operation and the ionic-current measurement are carried out simultaneously. The electrode for detecting ionic current may be led up to the end of the heating element on the combustion chamber side. The ionic current may be detected in a region of the combustion chamber where the combustion processes takes place in the combustion chamber. It is also illustrated to design two electrodes to detect ionic current in such a way that the ionic current flows from one electrode to the other electrode, and thus only crosses a region of special interest for the ionic-current measurement. It is shown to use the ceramic composite structure described below for the various heating-element layers, where conductivity and expansion coefficients may be adapted very well. This also applies for the precursor composites described below.

In the method for operating a sheathed-element glow plug having ionic-current measurement, the ionic-current detection may be provided during the glowing of the heating element, since it is of interest to detect the combustion process during the start phase of the internal combustion engine.

DETAILED DESCRIPTION

Figure 1:
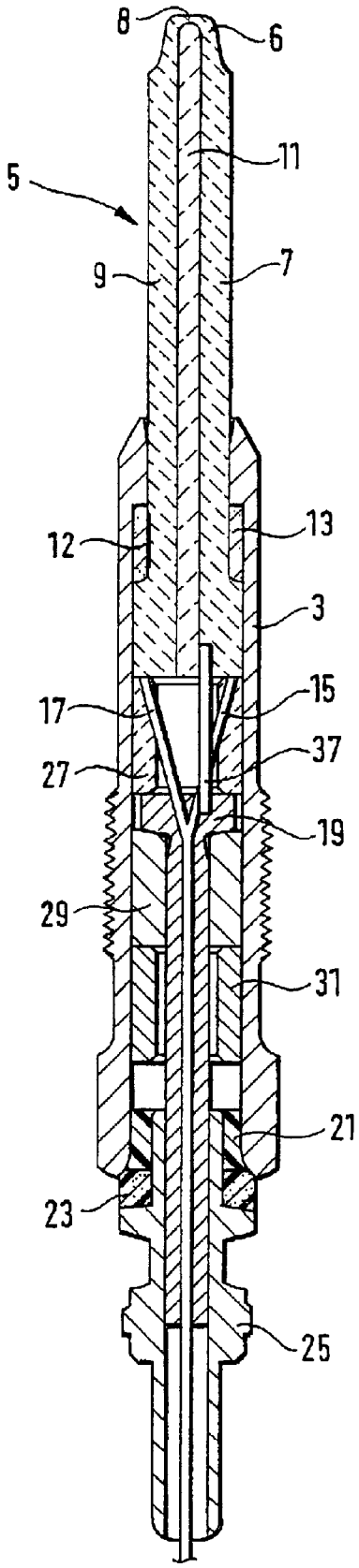
FIG. 1 is a longitudinal sectional view of a sheathed-element glow plug of the present invention with ionic-current sensor.

FIG. 1 illustrates a sheathed-element glow plug of the present invention schematically in longitudinal section. A tubular housing 3, which may be made of metallic material, contains a heating element 5 in its concentric bore hole at the end on the combustion chamber side. Heating element 5 may be made of ceramic material. Heating element 5 may have a first lead layer 7 and a second lead layer 9, first lead layer 7 and second lead layer 9 made of electroconductive ceramic material. At end 6 of heating element 5 remote from the combustion chamber, first lead layer 7 and second lead layer 9 are connected by a bar 8. In the example embodiment illustrated, the bar 8 may be made of electroconductive ceramic material. First lead layer 7 and second lead layer 9 may be separated from each other by an insulating layer 11. Insulating layer 11 may be made of electrically insulating ceramic material. The interior of housing 3 is sealed in the direction of the combustion chamber by a combustion-chamber seal 13 surrounding heating element 5 in a ring shape. At the end of heating element 5 remote from the combustion chamber, first lead layer 7 is connected to a third connection 37. In the direction of the end of the sheathed-element glow plug remote from the combustion chamber, this third connection 37 is connected to terminal stud 19. At its end remote from the combustion chamber, second lead layer 9 has a contact area 12 via which second lead layer 9 is electrically connected to housing 3 by way of electroconductive combustion-chamber seal 13. Housing 3 is connected to ground. In an example embodiment, contact area 12 may be constructed in such a way that in this region, the electrically insulating glass coating surrounding the end of heating element 5 remote from the combustion chamber is interrupted, and consequently an electrical contact is produced with combustion-chamber seal 13. In another example embodiment, contact area 12 is provided with a metallic coating.

Terminal stud 19 is set apart from the end of heating element 5 remote from the combustion chamber by a ceramic spacer sleeve 27 disposed in the concentric bore hole of housing 3. In the direction of the end remote from the combustion chamber, terminal stud 19 is led through a clamping sleeve 29 and a metal sleeve 31. At the end of the sheathed-element glow plug remote from the combustion chamber, a circular connector 25, which effects the electrical connection, is mounted on terminal stud 19. The end of the concentric bore hole of housing 3, remote from the combustion chamber, is sealed and electrically insulated by a tubing ring 21 and an insulating disk 23.

Figure 2:
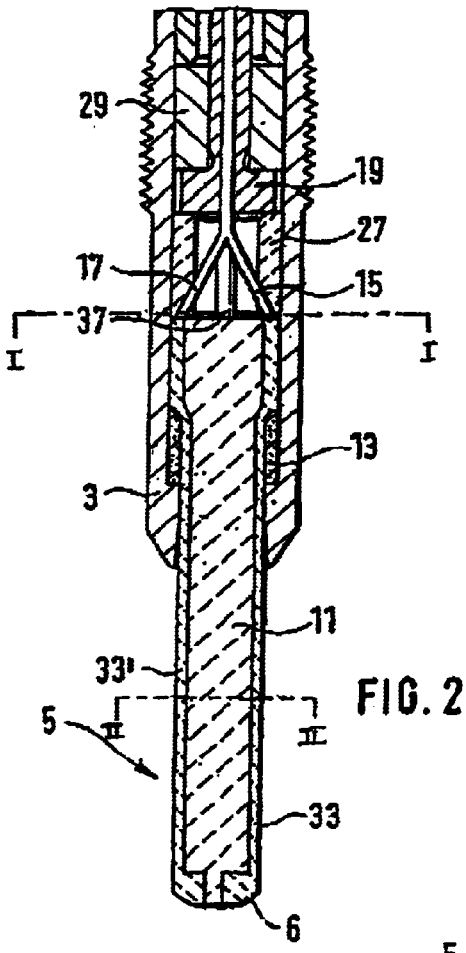
FIG. 2 is a schematic longitudinal sectional view through the combustion-chamber-side end of a sheathed-element glow plug of the present invention with ionic-current sensor.

The present invention is also illustrated in FIG. 2. Only the end of a sheathed-element glow plug according to the present invention on the combustion chamber side is illustrated schematically in longitudinal section. Compared to FIG. 1, heating element 5 is intersected in a plane transverse to the sectional plane of FIG. 1. Here, only insulating layer 11 is visible. Within insulating layer 11 two electrodes 33 and 33' are placed for detecting ionic current which are broadened at end 6 of heating element 5 on the combustion chamber side. In a further example embodiment, electrodes 33 and 33' may also be applied outside on the insulating layer. At the end of heating element 5 remote from the combustion chamber, first electrode 33 for detecting ionic current is connected to a first connection 15. Second electrode 33' for detecting ionic current is likewise connected at the end of heating element 5 remote from the combustion chamber to a second connection 17. First connection 15 and second connection 17 are passed through terminal stud 19 to the end of the sheathed-element glow plug remote from the combustion chamber. As previously mentioned, first lead layer 7 is connected to terminal stud 19 with the aid of a third connection 37.

Figure 3A:
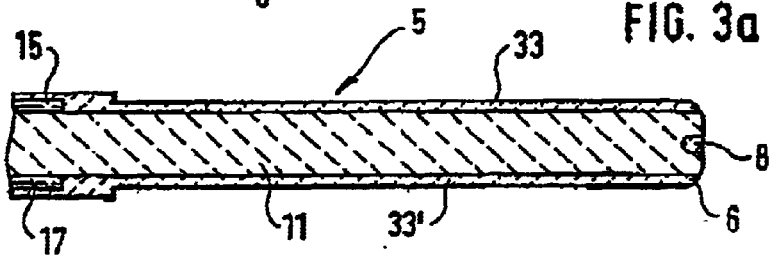
FIG. 3*a* shows a first schematic longitudinal sectional view through the heating element of a sheathed-element glow plug of the present invention with ionic-current sensor.

The arrangement of the various layers of heating element 5 together with the associated connections are illustrated again with reference to FIG. 3. FIG. 3*a* illustrates a heating element 5 in longitudinal section. First electrode 33 for detecting ionic current and second electrode 33' for detecting ionic current are disposed in insulating layer 11. At the end of heating element 5 remote from the combustion chamber, first electrode 33 for detecting ionic current is connected to first connection 15, and second electrode 33' for detecting ionic current is connected to second connection 17. In addition, at the end of heating element 5 on the combustion chamber side, bar 8 is discernible which connects first lead layer 7 and second lead layer 9 to one another.

Figure 3B:
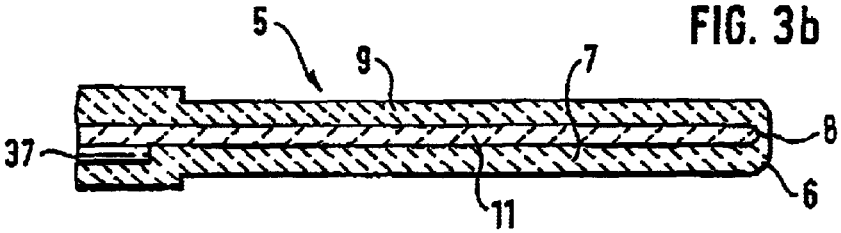
FIG. 3*b* shows a second schematic longitudinal sectional view through the heating element of a sheathed-element glow plug of the present invention with ionic-current sensor.

FIG. 3*b* shows heating element 5 which is intersected in a plane transverse to the plane in which heating element 5, which was illustrated in FIG. 3*a*, is intersected. First lead layer 7 and second lead layer 9 are interconnected via bar 8 at end 6 of heating element 5 remote from the combustion chamber. Third connection 37 is connected to first lead layer 7 at the end of heating element 5 remote from the combustion chamber.

Figure 4:
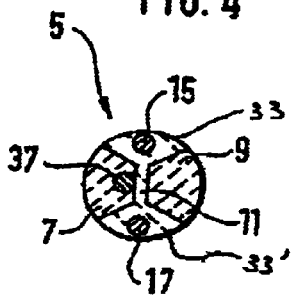
FIG. 4 shows a schematic cross-sectional view taken along sectional line I—I shown in FIG. 2, through a heating element of a sheathed-element glow plug of the present invention with ionic-current sensor.

FIG. 4 shows a cross-section taken along cross-sectional line I—I shown in FIG. 2, through heating element 5 at the end remote from the combustion chamber. First lead layer 7 is separated from second lead layer 9 by insulating layer 11. Arranged within insulating layer 11 is first connection 15 which is connected to first electrode 33 for detecting ionic current. Likewise arranged within insulating layer 11 is second connection 17 which is connected to second electrode 33' for detecting ionic current. Third connection 37 is disposed within first lead layer 7. To better accommodate and insulate first and second electrodes 33, 33' for detecting ionic current, the insulating layer is broadened in the region in which these electrodes are arranged.

Figure 5:
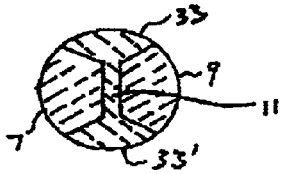
FIG. 5 shows a cross-sectional view taken along sectional line II—II shown in FIG. 2, through a heating element of a sheathed-element glow plug of the present invention with ionic-current sensor.

FIG. 5 shows a cross-sectional view taken along sectional line II—II shown in FIG. 2, through heating element 5 at the end remote from the combustion chamber. First lead layer 7 is separated from second lead layer 9 by insulating layer 11. Also shown are first electrode 33 and second electrode 33' for detecting ionic current.

In a first example embodiment, the sheathed-element glow plug may be operated in such a way that during the start of the internal combustion engine, the sheathed-element glow plug is initially operated in heating mode. During the glow phase, a positive voltage with respect to ground is applied to third connection 37, so that a current flows across first lead layer 7, bar 8 and second lead layer 9. Due to the electrical resistance on this path, the temperature of the heating element rises, and the combustion chamber, into which the end of the sheathed-element glow plug on the combustion chamber side extends, is heated. After ending the glow phase, a voltage potential is applied to first connection 15 and second connection 17, so that first electrode 33 and second electrode 33' are used as electrodes for measuring ionic current. If the combustion chamber is ionized due to the presence of ions, then an ionic current may flow from electrodes 33, 33' for detecting ionic current to the combustion-chamber wall which is grounded. In this example embodiment, first electrode 33 for detecting ionic current and the second electrode for detecting ionic current act as electrodes at the same potential in parallel.

In a further example embodiment, a different voltage potential may be applied to first electrode 33 for detecting ionic current and second electrode 33' for detecting ionic current so that an ionic current flows between first electrode 33 for detecting ionic current and second electrode 33' for detecting ionic current.

In another example embodiment, the glow operation and the detection of ionic current may be carried out simultaneously by the sheathed-element glow plug. The voltage for the glow operation and for detecting ionic current is applied simultaneously to third connection 37 and to first and second connections 15, 17, respectively. The voltage potentials may be selected such that first electrode 33 for detecting ionic current and second electrode 33' for detecting ionic current are at the same or different potential, as described above, the ionic current flows via the ionized combustion chamber to the combustion chamber wall, or from first electrode 33 for detecting ionic current via the ionized combustion chamber to second electrode 33' for detecting ionic current.

In a first example embodiment, the materials of first lead layer 7, bar 8, second lead layer 9, insulating layer 11 and electrode 33 for detecting ionic current, as well as second electrode 33' for detecting ionic current may be made of ceramic material. This ensures that the thermal expansion coefficients of the materials scarcely differ, thus guaranteeing the endurance strength of heating element 5. The material of first lead layer 7, bar 8 and second lead layer 9 is selected such that the resistance of these layers is less than the resistance of insulating layer 11. The resistance of first electrode 33 for detecting ionic current and second electrode 33' for detecting ionic current is less than the resistance of insulating layer 11.

In a further example embodiment, first electrode 33 for detecting ionic current and second electrode 33' for detecting ionic current may also be made of metallic material, e.g. platinum.

In another example embodiment, first lead layer 7, bar 8 and second lead layer 9, insulating layer 11 and possibly first electrode 33 and second electrode 33' are made of ceramic composite structures which contain at least two of the compounds $AL_2O_3$, $MoSi_2$, $Si_3N_4$ and $Y_2O_3$. These composite structures are obtainable by a one-step or multi-step sintering process. The specific resistance of the layers may preferably be determined by the $MoSi_2$ content and/or the grain size of $MoSi_2$; the $MoSi_2$ content of first lead layer 7, of bar 8 and of second lead layer 9, as well as of first and second electrodes 33, 33' for detecting ionic current may be higher than the $MoSi_2$ content of insulating layer 11.

In a further example embodiment, first lead layer 7, bar 8, second lead layer 9, insulating layer 11 and possibly first electrode 33 for detecting ionic current and second electrode 33' for detecting ionic current are made of a composite precursor ceramic having different portions of fillers. The matrix of this material is made of polysiloxanes, polysesquioxanes, polysilanes or polysilazanes which may be doped with boron, nitrogen or aluminum and are produced by pyrolysis. At least one of the compounds $Al_2O_3$, $MoSi_2$, $SiO_2$ and SiC forms the filler for the individual layers. Analogous to the composite structure indicated above, the $MoSi_2$ content and/or the grain size of $MoSi_2$ may determine the resistance of the layers. The $MoSi_2$ content of first lead layer 7, of bar 8 and of second lead layer 9, and possibly of first and second electrodes 33, 33' for detecting ionic current may be set higher than the $MoSi_2$ content of insulating layer 11. In the example embodiments indicated above, the compositions of first lead layer 7, bar 8, second lead layer 9, insulating layer 11 and possibly of first electrode 33 for detecting ionic current and second electrode 33' for detecting ionic current are selected such that their thermal expansion coefficients and the shrinkages occurring during the sintering and pyrolysis processes are identical, so that no cracks develop in heating element 5.

What is claimed is:

1. A sheathed-element glow plug provided with an ionic-current sensor, comprising:

a housing; and a rod-shaped heating element arranged in a concentric bore hole of the housing, the heating element including:

at least one insulating layer made of an electrically insulating ceramic material, a first lead layer made of an electroconductive ceramic material, a second lead layer made of the electroconductive ceramic material, a bar located at an end of the heating element on a combustion chamber side and made of the electroconductive ceramic material, the first lead layer and the second lead layer being connected directly at the end of the heating element on the combustion chamber side via the bar, a first electrode for detecting an ionic current, and a second electrode for detecting the ionic current, the first electrode and the second electrode being one of embedded in the at least one insulating layer and applied on the at least one insulating layer, wherein the first and second electrodes are not connected to the first and second lead layers.

2. The sheathed-element glow plug according to claim 1, wherein the first electrode and the second electrode are made of a metallic material.

3. The sheathed-element glow plug according to claim 1, wherein the first electrode and the second electrode are made of platinum.

4. The sheathed-element glow plug according to claim 1, wherein the first electrode and the second electrode are made of the electroconductive ceramic material.

5. The sheathed-element glow plug according to claim 4, wherein the first electrode and the second electrode are made from a ceramic composite structure that is made of at least two of the compounds $Al_2O_3$, $MoSi_2$, $Si_3N_4$, and $Y_2O_3$ in accordance with one of a one-step sintering process and a multi-step sintering process.

6. The sheathed-element glow plug according to claim 4, wherein the first electrode and the second electrode are made from a composite precursor ceramic including a matrix and a filler, the matrix including one of a polysiloxane, a polysilsesquioxane, a polysilane, and a polysilazane, doped with one of boron, nitrogen, and aluminum and produced by pyrolysis, the filler being formal from at least one of the compounds $Al_2O_3$, $MoSi_2$, $SiO_2$ and SiC.

7. The sheathed-element glow plug according to claim 1, further comprising:

a first electrical connection; and a second electrical connection, wherein the first electrical connection and the second electrical connection are arranged at an end of the heating element remote from the combustion chamber, the first electrical connection being connected to an end of the first electrode remote from the combustion chamber, and the second electrical connection being connected to an end of the second electrode remote from the combustion chamber.

8. The sheathed-element glow plug according to claim 1, further comprising:

a combustion chamber seal, wherein the second lead layer is connected to ground via the housing and the combustion-chamber seal.

9. The sheathed-element glow plug according to claim 1, further comprising:

a tubular spacer sleeve made of an electrically insulating material and arranged at an end of the heating element remote from the combustion chamber within the concentric bore hole of the housing.

10. The sheathed-element glow plug according to claim 1, wherein the at least one insulating layer, the first lead layer, the bar, and the second lead layer are made from a ceramic composite structure that is made of at least two of the compounds $Al_2O_3$, $MoSi_2$, $Si_3N_4$, and $Y_2O_3$ in accordance with one of a one-step sintering process and a multi-step sintering process.

11. The sheathed-element glow plug according to claim 1, wherein the at least one insulating layer, the first lead layer, the bar, and the second lead layer are made from a composite precursor ceramic including a matrix and a filler, the matrix including one of a polysiloxane, a polysilsesquioxane, a polysilane, and a polysilazane, the matrix doped with one or boron, nitrogen, and aluminum and produced by pyrolysis, the filler made from at least one of the compounds $Al_2O_3$, $MoSi_2$, $SiO_2$, and SiC.

12. A method for operating a sheathed-element glow plug having an ionic-current sensor, comprising:

applying an electrical voltage to a first lead layer and a second lead layer during a glow phase, wherein the first lead layer and the second lead layer are connected directly at an end of the glow plug on a combustion chamber side via a bar; and after the glow phase ends, applying the electrical voltage to a first electrode for detecting an ionic current and to a second electrode for detecting the ionic current, wherein the first and second electrodes are not connected to the first and second lead layers.

13. The method according to claim 12, wherein the electrical voltage applied to the first electrode and the electrical voltage applied to the second electrode have a same potential.

14. The method according to claim 12, wherein the electrical voltage applied to the first electrode and the electrical voltage applied to the second electrode have a different potential.

15. A method for operating a sheathed-element glow plug having an ionic-current sensor, comprising:

during a glow phase, applying an electrical voltage to a first lead layer, a second lead layer, a first electrode for detecting an ionic current, and a second electrode for detecting the ionic current, wherein the first lead layer and the second lead layer are connected directly at an end of the glow plug on a combustion chamber side via a bar, and wherein the first and second electrodes are not connected to the first and second lead layers.

16. The method according to claim 15, wherein the electrical voltage applied to the first electrode and the electrical voltage applied to the second electrode have a same potential.

17. The method according to claim 15, wherein the electrical voltage applied to the first electrode and the electrical voltage applied to the second electrode have a different potential.

* * * * *

UNITED STATES PATENT AND TRADEMARK OFFICE

CERTIFICATE OF CORRECTION

PATENT NO. : 6,921,879 B2
APPLICATION NO. : 10/070113
DATED : July 26, 2005
INVENTOR(S) : Christoph Haluschka et al.

It is certified that error appears in the above-identified patent and that said Letters Patent is hereby corrected as shown below:

Column 5, line 66, claim 6, change “formal” to --formed--

Column 6, line 36, claim 11, change “one or boron, nitrogen...” to --one of boron, nitrogen...--

Signed and Sealed this

Eighteenth Day of September, 2007

JON W. DUDAS
*Director of the United States Patent and Trademark Office*